US006434525B1

(12) United States Patent
Nagisa et al.

(10) Patent No.: US 6,434,525 B1
(45) Date of Patent: Aug. 13, 2002

(54) HUMAN IMAGE DIALOGUE DEVICE AND A RECORDING MEDIUM STORING A HUMAN IMAGE DIALOGUE DEVICE

(75) Inventors: Izumi Nagisa; Dai Kusui, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/318,806

(22) Filed: May 26, 1999

(30) Foreign Application Priority Data

May 27, 1998 (JP) ..... 10-145380

(51) Int. Cl.[7] ..... G10L 21/06

(52) U.S. Cl. ..... 704/260; 704/270; 704/275; 704/276

(58) Field of Search ..... 704/270, 275, 704/276, 260, 251; 345/326, 333, 729

(56) References Cited

U.S. PATENT DOCUMENTS 5,208,745 A * 5/1993 Quentin et al. ..... 364/188
5,223,828 A * 6/1993 McKiel, Jr. ..... 340/825.19
5,500,919 A * 3/1996 Luther ..... 704/260
5,548,681 A * 8/1996 Gleaves et al. ..... 704/233
5,572,625 A * 11/1996 Raman et al. ..... 704/260
5,777,614 A * 7/1998 Ando et al. ..... 345/333
5,799,276 A * 8/1998 Komissarchik et al. ..... 704/251
5,929,848 A * 7/1999 Albukerk et al. ..... 345/326
5,983,190 A * 11/1999 Trower, II et al. ..... 704/276
6,112,177 A * 8/2000 Cosatto et al. ..... 704/260
6,128,010 A * 10/2000 Baxter et al. ..... 345/333
6,216,013 B1 * 4/2001 Moore et al. ..... 455/557

FOREIGN PATENT DOCUMENTS

JP 7-325868 12/1995
JP 9-16800 1/1997
JP 11-242751 9/1999

* cited by examiner

*Primary Examiner*—Richemond Dorvil
*Assistant Examiner*—Susan McFadden
(74) *Attorney, Agent, or Firm*—Sughrue Mion, PLLC

(57) ABSTRACT

A device is provided that generates the gestures and expressions of a human image on a computer without expending a great amount of labor. The words for the system response to the input of a user and the state of the dialogue are described in a dialogue flow memory unit, a dialogue flow analysis unit analyzes the spoken text of the flow, extracts the key words associated with a movement pattern by referring to a text movement association table, and the movement expression generation unit generates the movements corresponding to the movement pattern. In the generation of the movement, movement patterns determined in advance are selected according to the state of the dialogue written in the dialogue flow, and the movement pattern is determined or modified by the key words. In addition, in a text output control unit, words are displayed by switching between the display of a "conversation balloon" or the display of a "message board" according to the state of the dialogue written in the dialogue flow.

14 Claims, 6 Drawing Sheets

Fig. 4

| MOVEMENT PATTERN | CONTENT OF MOVEMENT |
|---|---|
| GREETING | LOWER THE HEAD |
| CONFIRMATION | TILT THE HEAD |
| POINTING DOWN | EXTEND THE INDEX FINGER, ANDPOINT TO THE MESSAGE BOARD INFRONT |
| POINTING TO THE RIGHT | EXTEND THE INDEX FINGER ANDPOINT TO THE RIGHT |
| POLITE GREETING | LOWER THE HEAD WHILE BOWING |
| REFUSAL | SHAKE HEAD |
| SWITCH | TURN AROUND ONCE |
| FAILURE | MAKE A SAD FACE |

| DIALOGUE TEXT | MOVEMENT PATTERN |
|---|---|
| WELCOME! | GREETING |
| ARE YOU? | CONFIRMATION |
| PLEASE ENTER. | POINTING TO THE RIGHT |
| AS SHOWN IN THE LEFT. | POINTING |
| THANK YOU. | POLITE GREETING |
| NONE. | REFUSAL |

HUMAN IMAGE DIALOGUE DEVICE AND A RECORDING MEDIUM STORING A HUMAN IMAGE DIALOGUE DEVICE

BACKGROUND OF THE INVENTION

1. Field of the Invention

The present invention relates to a human image dialogue device and a recording medium that records a human dialogue program that automatically generates the output of the movements, voice, and the words of the human image according to text and dialogue flow output from a module that controls the dialogue in a system having a character such as a human image (hereinbelow, referred to as a "human image") appear on a computer, and carries out a dialogue with the user of the computer with this human image.

2. Description of the Related Art

Conventionally, the technologies disclosed in Japanese Patent Application, unexamined First Publication, No. Hei 9-274666, "Human Image Synthesizing Device" (hereinbelow, referred to as Citation 1); Japanese Patent Application, unexamined First Publication, No. Hei 9-16800, "Voice Dialogue System with Facial Image" (hereinbelow, referred to as Citation 2); Japanese Patent Application, unexamined First Publication, No. Hei 7-334507,"Human Movement and Voice Generation System from Text" (hereinbelow, referred to as Citation 3); and Japanese Patent Application, unexamined First Publication, No. Hei 9-153145, "Agent Display Device" (hereinbelow, referred to as Citation 4), are known technologies.

First, in Citation 1, a system is proposed wherein a human mouth shape is generated from the frequency component of voice data, and a nodding movement is generated from the silent intervals in the voice data, and thereby an image of a human talking is displayed.

In addition, in Citation 2, discloses a voice recognition dictionary with spoken keywords having an expression code, and proposes a system wherein a response with a face image exhibiting feelings is returned as a result of the voice input of the user.

In addition, in Citation 3, a system is proposed wherein a spoken text written in a natural language is analyzed, the verbs and adverbs are extracted, the body movement pattern corresponding to the verb is determined, and the degree of motion of the movements is determined using the modifiers.

Furthermore, in Citation 4, an agent display device is proposed wherein, when activated, the rules of movement of a human-shaped agent are described by If-Then rules, so that the agent appears, gives a greeting, etc.

The first problem of the above-described conventional technology is that the description of the movements of the displayed human image is complex, and as a result great labor must be expended during the dialogue system construction. The reason for this is that, in Citation 4, for example, the movements of the agent must be described by If—Then rules, and for each dialogue system, it is necessary to describe the state of the system and the movements of the agent, which are the conditions, in detail, and this is complex.

The second problem is that expressions and movements in which the actions of the characters do not match the situation of the dialogue are generated, and movements and expressions are always repeated in the same manner. The reason for this is that in systems wherein expression and movement are synthesized from voice information and spoken text, such as is the case in Citation 1, Citation 2, and Citation 3, the same movements and expressions are generated for the same words no matter what the state of the dialogue because the expressions and movements are automatically generated from natural language, and thus the state of the dialogue does not match, and fixed movements are repeated.

SUMMARY OF THE INVENTION

In consideration of the above-described problems in the conventional technology, it is an object of the present invention to provide a human image dialogue device and a recording medium recording a human image dialogue program wherein generalized generation of gestures, expressions, etc., can be carried out in order to generate a human image on a computer that can carry out a dialogue similar to that between humans, without the expending of a large amount of labor during the construction of the dialogue system.

The human image dialogue device of the present invention comprises a dialogue control unit (2 in FIG. 1) that prompts the responses between the user and system by using a dialogue flow that describes a flow that associates the words for the system response (hereinbelow, referred to as the "spoken text") and the state of the dialogue between the user and the system in this dialogue text, and a human image generation unit (5 in FIG. 1) that generates the motions, expression, conversation balloons of the words in the spoken text, and voice of the human image automatically from the spoken text written in this dialogue flow and the state of the dialogue.

More specifically, the spoken text responding to the input of the user and the state of the dialogue are recorded in the dialogue flow memory (3 in FIG. 1), and the dialogue flow is analyzed in the dialogue flow analysis unit (4 in FIG. 1).

Next, in the movement-expression generation unit (51 in FIG. 1), based on the results of the analysis of the dialogue flow in the dialogue analysis unit, the movements of the human image are generated referring to one or both of the text-movement associating memory unit (52 in FIG. 1), which associates keywords and movement patterns of this human image (FIG. 5) and the movement data memory unit (52 in FIG. 1), which describes the movement patterns and the content of the movements associated with this movement pattern (FIG. 4). The generation of the movement of this movement-expression generation unit selects a predetermined movement pattern according to the state of the dialogue written in the dialogue flow and determines the movement to be generated by the keywords included in the dialogue text.

In addition, depending on the state of the dialogue in the dialogue flow, the text output control unit (54 in FIG. 1), for example, displays a "conversation balloon" whose display starts when the human image on the screen starts speaking and closes when the conversation ends, or displays a "message board" whose display starts at the same time the human image starts to speak but does not close even after the conversation has finished, etc., switches the display format, and displays the words included in the spoken text.

Furthermore, the invention can be constructed so that by the voice synthesis unit (55 in FIG. 1), spoken text can be output by voice synthesis, and by the synchronization unit (56 in FIG. 1), the output of the movement-expression generation unit, the text output control unit, and the voice synthesis unit will be synchronous.

Thus, it is possible to generate the motions and expressions which match the state of the dialogue without describing the behavior of the human image in detail because the movements of the human image are generated according to the dialogue flow, and thus the first problem of expending great labor during the construction of the system is solved. In addition, because the different movements are selected and movements modified depending on the state of the dialogue written in the dialogue flow and the number of repetitions of the dialogue flow, the second problem of generating expressions and movements of the character that do not match the state of the dialogue and always repeating the same movements and the expressions is solved.

BRIEF DESCRIPTION OF THE DRAWINGS

FIG. 4 is a drawing showing an example of the movement pattern and the contents of the movement stored in the movement data memory unit of the present invention.

DESCRIPTION OF THE EMBODIMENTS

Figure 1:
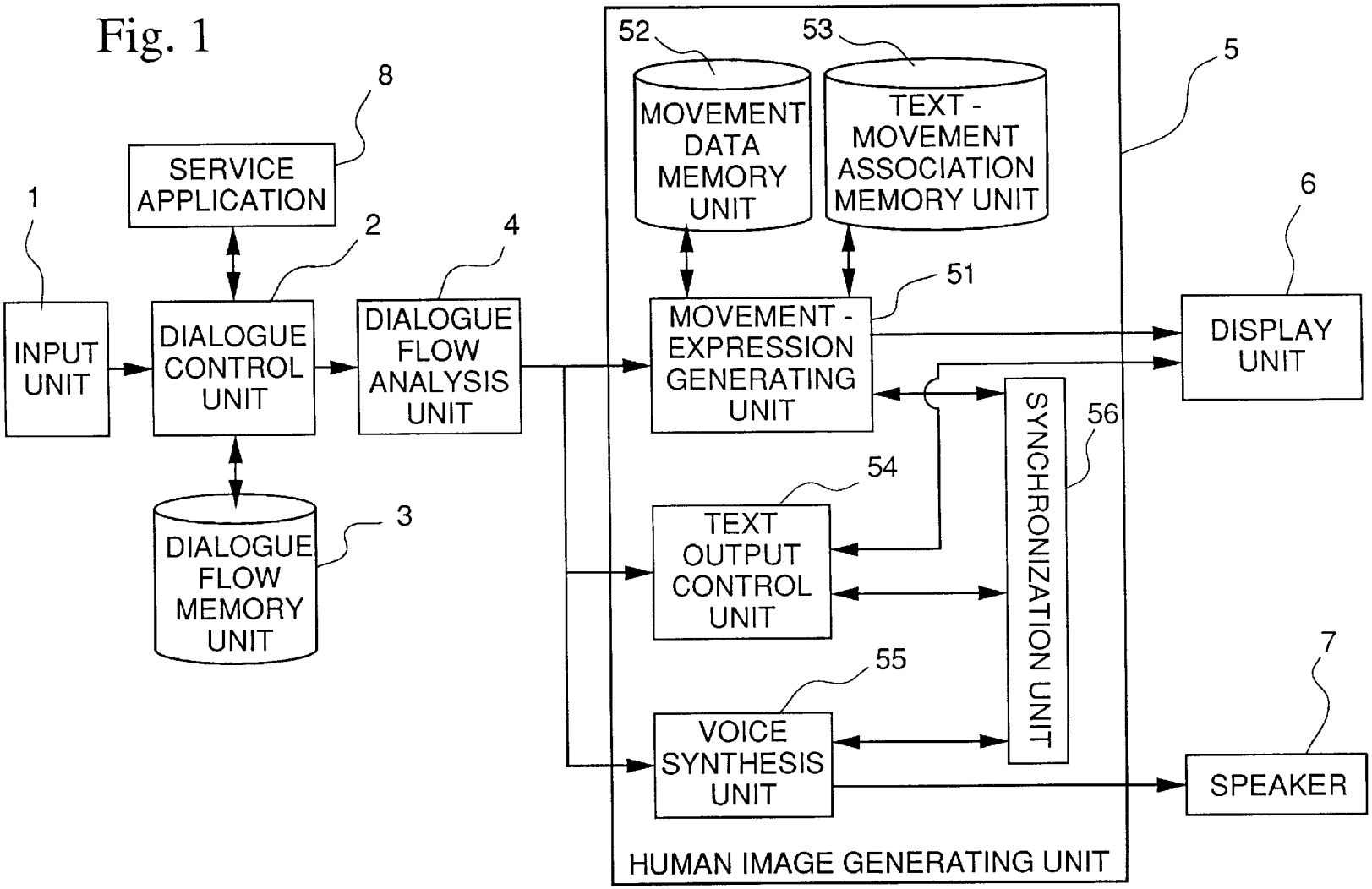
FIG. 1 is a block drawing showing the first embodiment of the structure of the present invention.

Next, the embodiments of the present invention will be explained in detail referring to the drawings.

FIG. 1 is a block diagram showing an example of the structure of the first embodiment of the present invention. The structure of the present embodiment will be explained using FIG. 1.

The invention according to the present embodiment comprises an input unit 1, such as a keyboard, a dialogue control unit 2 that controls the dialogue, a service application 8 that carries out a service such as a search and can output the result of this service, a dialogue flow memory unit 3 that stores the dialogue flow describing the flow that associates the words of the system response (the spoken text) and the state of the dialogue between the user and the system in this spoken text, a dialogue flow analysis unit 4 that interprets the dialogue flow sent from the dialogue control unit 2, a human image generation unit 5 that controls the generation of the movements, expressions, words, etc., of the human image, a display unit 6 such as a display, and a speaker 7 for outputting the voice, etc.

In addition, the human image generation unit 5 comprises the movement-expression generation unit 51 that generates the movements of the body, the facial expressions, etc., of the human image based on the results of the analysis of the dialogue flow analysis unit 4, a movement data memory unit 52 referred to while carrying out the generation of the movement in the movement-expression generation unit 51 and that stores the movement patterns and the necessary contents of these movements for "bow, "point", "refuse", etc., the text-movement pattern associating memory unit 53 referred to when the movement-expression generation unit 51 associates a spoken text sent from the dialogue flow analysis unit 4 to a movement and generates that movement, a text output control unit 54 that controls the voice output and the words spoken by the human image and their display on the screen, a voice synthesizing unit 55 that accepts the spoken text sent from the dialogue flow analysis unit 4 as input, and carries out voice syntheses of the words of the human image, and a synchronizing unit 56 that synchronizes the movements and the expressions generated by the movement-expression generation unit 51 and the words generated by the text output control unit 54 and the voice generated by a voice synthesis unit 55.

First Embodiment

Next, the present invention will be explained in detail by presenting a concrete embodiment while referring to the figures.

In this embodiment, an airline ticket reservation service that carries out reservation of airline tickets will be explained as a concrete example of a service application 8, but the present invention is not limited only to this application, and can be adapted for various types of applications.

First, the user enters a command from the input unit 1 into the service application 8. In addition, in this example, entered items necessary for a reservation, such as "point of departure", "destination", and "time of departure", and responses to confirm the reservation are commands that can be entered by the user. An explanation of the entries of the user carried out via the input unit 1 are explained below.

Figure 2:
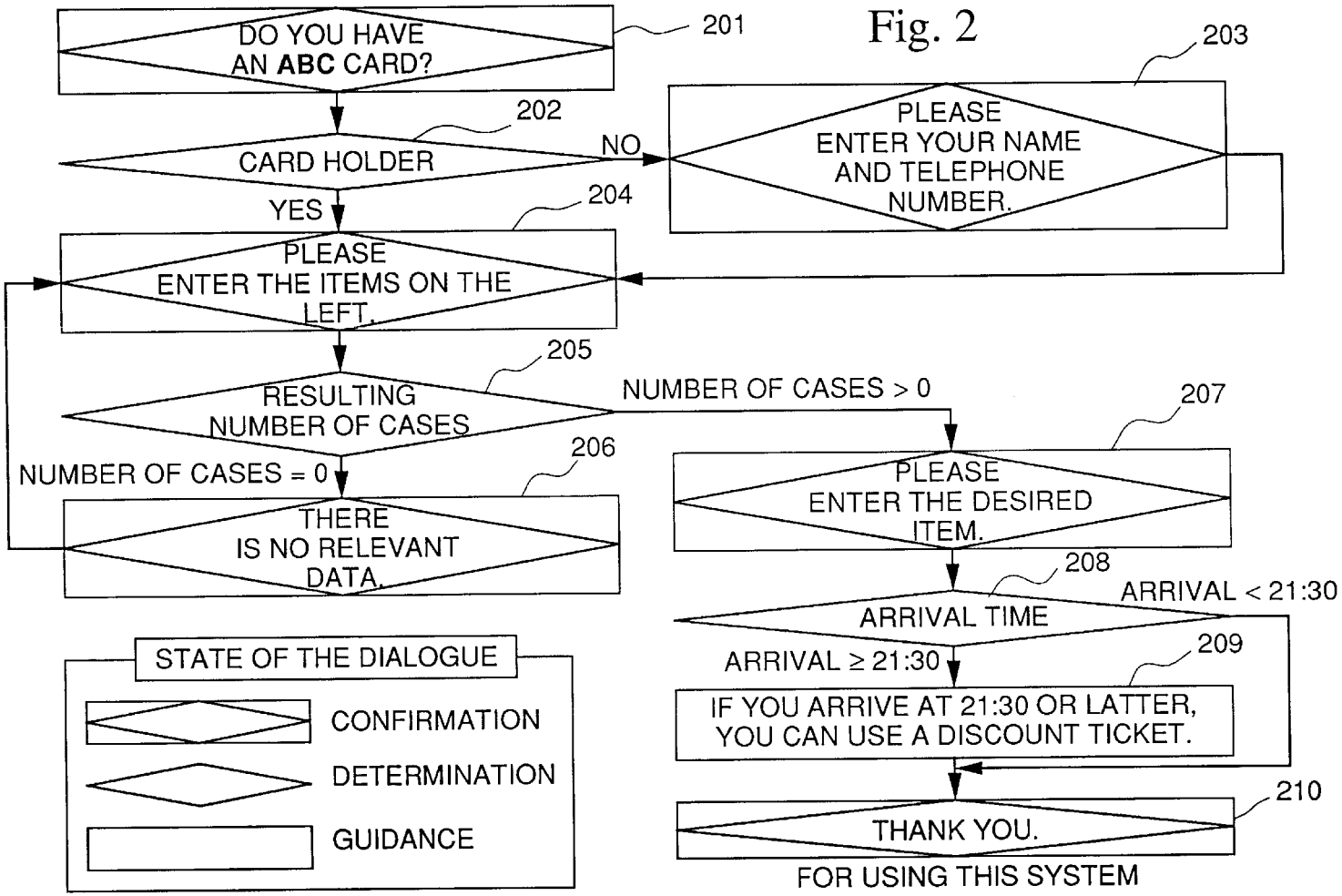
FIG. 2 is a drawing showing a data example recorded in the dialogue flow memory unit of the present invention.

In the dialogue flow memory unit 3, as shown in FIG. 2, for the entered commands of the user, a dialogue flow that describes the spoken text for carrying out a dialogue between the system and the user, and the state of the dialogue between the system and the user in this dialogue text are stored. Three types of examples of the state of the dialogue in this example are stored: confirmation of the system response (confirmation to the user), determination (determination of the information), and guidance (displaying guidance to the user).

Next, the dialogue control unit 2 determines the response of the system corresponding to the commands input from the input unit 1 by referring to the dialogue flow stored in the dialogue flow memory unit 3, and in addition, receives and outputs the result of the search from the service application 8 for the searches for each entered item. The technology for a dialogue form manipulation support device disclosed, for example, in Japanese Patent Application, unexamined First Publication, No. Hei 9-91108, can be used to realize the service application 8, the dialogue control unit 2, and the dialogue flow memory unit 3.

The dialogue flow analysis unit 4 refers to the dialogue flow referred to in the dialogue control unit 2 and the dialogue flow determined by the dialogue control unit 2, and carries out a determination as to whether the state of the dialogue in the present dialogue flow is confirmation or guidance, or whether the dialogue flow is switching, the flow has failed, or the flow is repeating, etc.

Figure 3:
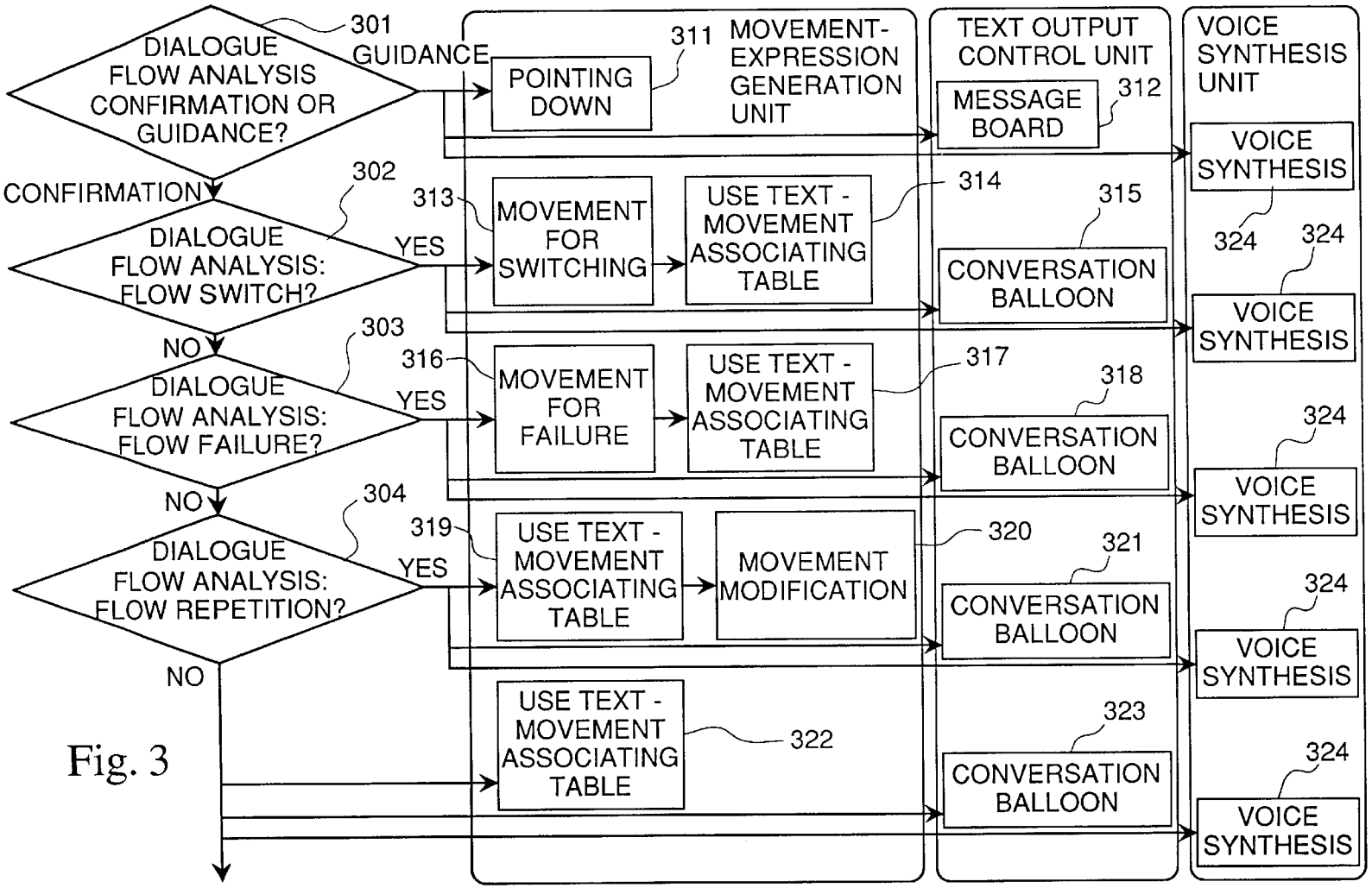
FIG. 3 is a flow chart for explaining an example of motion in the present invention.

In addition, the dialogue flow analysis unit 4 sends the results of this determination and the spoken text described in the dialogue flow to the movement-expression generation unit 51, the text output control unit 54, and the voice synthesis unit 55. Examples of this determination of the dialogue flow analysis unit 4, as shown in FIG. 3, are whether the state of the dialogue is confirmation or guidance (step 301), whether the dialogue flow is switching (step 302), whether the dialogue flow has failed (step 303), whether the dialogue flow is repeating (step 304), etc.

The human image generation unit 5 accepts as input the spoken text, the state of the dialogue, and the determination as to whether the dialogue flow is switching, etc., sent from the dialogue flow analysis unit 4, and the movement-expression generation unit 51 outputs the movement and expression of the human image, the text output control unit 54 outputs the output format of the words of the human image to the screen, the voice synthesis unit 55 outputs the voicing for the words, while the synchronization is set in the synchronization unit 56.

The movement-expression generation unit 51 generates the movement of the human image from the determination and the spoken text sent from the dialogue flow analysis unit 4. For example, in the dialogue flow analysis unit 4, when the state of the dialogue flow is determined to be guidance (step 301), the action of the movement-expression generation unit 51 is "pointing down" (step 311), so the data corresponding to this "pointing down" is called from the movement data memory unit 52, the movement of the human image is generated. At this time, in the movement data memory unit 52, as shown in FIG. 4, the movement pattern for "greeting", "confirmation", "pointing", etc., and the contents of the movements corresponding to these movement patterns are stored, and in the movement-expression generation unit 51 the movement of the human image is generated according to the content of the movements stored in the movement data memory unit 52. For example, in the case of "pointing down", the motion of each joint is described so that the message board is indicted and the index finger is extended.

In addition, the text output control unit 54 determines the output format of the words of the human image according to the determination of whether or not the dialogue flow sent from the dialogue flow analysis unit 4 is guidance or confirmation. For example, in the dialogue flow analysis unit 4, when the dialogue flow is determined to be guidance (step 301 in FIG. 3), the text output control unit 54 accepts the spoken text sent from the dialogue flow analysis unit 4 as input, and as shown in 601 of FIG. 6, outputs words on the message board, continues the display even after the human image has finished speaking so that the user can read the contents thoroughly (step 312).

The voice synthesis unit 55 accepts the spoken text sent from the dialogue flow analysis unit 4 as input, and generates the voice synthesis of the words (step 324).

The synchronization unit 56 synchronizes the display of the pointing movements generated by the movement-expression generation unit 51, the voice synthesized in the voice synthesis unit 55, and the words output by the text output control unit 54, and controls the display of the movements, voice, and words so that they start simultaneously. The words are synchronized with the reading aloud by the voice, they are displayed on the message board, and the display on the message board continues after the reading of the words has completed. The display of guidance continues until the commencement of the next guidance.

The display unit 6 displays the movements, expressions, and words, and the speaker 7 outputs the voice.

Figures 5, 6:
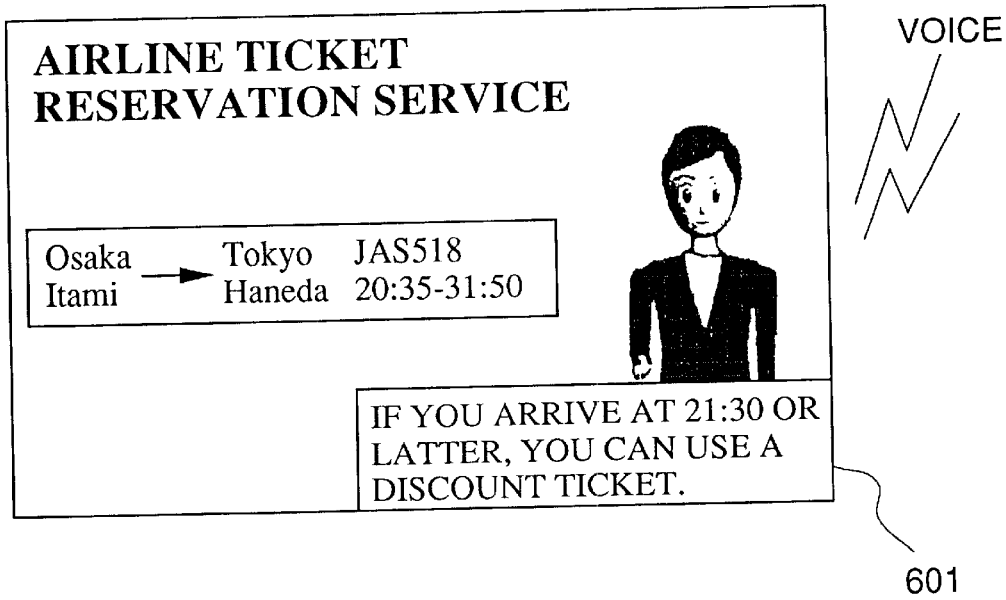
FIG. 5 is a drawing showing an example of a keyword and a movement pattern stored in the text movement associating memory unit of the present invention.
FIG. 6 is a drawing showing an example of the display of the message board in an airline ticket reservation service in the first embodiment of the present invention.

Next, in step 301 of FIG. 3, when the state of the dialogue flow is determined to be confirmation, and in step 302, the dialogue flow is determined to be switching, the movement-expression generation unit 51 calls the data corresponding to the switching movement from the movement data memory unit 52, and for example, as shown in FIG. 4, switching movement, for example, the movement of the human image turning around one time, is generated, and the user is informed that the topic is changing (step 313). Next, the movement-expression generation unit 51 analyzes the spoken text sent from the dialogue flow analysis unit 4, uses the keyword movement pattern conversion chart that associates a spoken text and a keyword and is stored in the text-movement association memory unit 53, determines the movement pattern from the spoken text, calls the corresponding movement pattern data from the movement data memory unit 52, and generates the movement (step 314). The text movement association table, as shown in FIG. 5, stores an association chart for the keywords and the movements, and, for example, when the keywords "please enter" are extracted from the spoken text, the movement pattern corresponding to "enter please" is determined to be "pointing to the right", and the movement pattern data corresponding to "pointing to the right" is called from the movement data memory unit 52, and the motion of the pointing to the right is generated.

Figure 7:
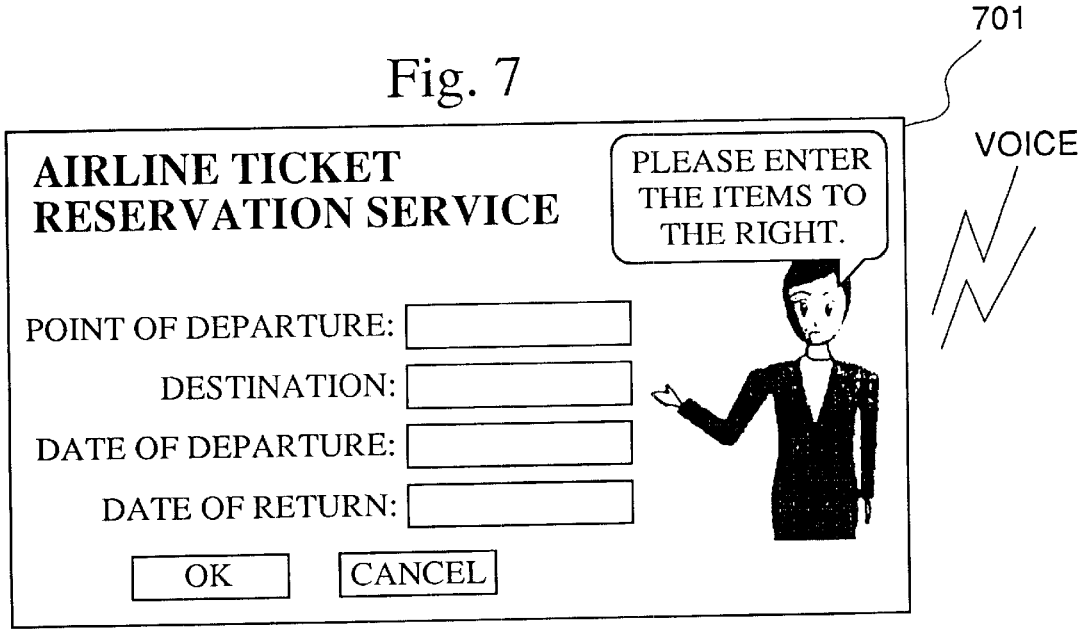
FIG. 7 is a drawing showing an example of the conversation baloon display in the airline ticket reservation service in the first embodiment of the present invention.

In addition, when the state of the dialogue flow is confirmation, as shown in 701 of FIG. 7, the text output control unit 54 carries out control so as to output the words being spoken to a conversation balloon (step 315). The voice synthesis unit 55 accepts the spoken text sent from the dialogue flow analysis unit 4 as input, and carries out voice synthesis of the words (step 324).

For the spoken text whose keywords have been extracted, the synchronization unit 56 synchronizes display of the commencement of the movements generated by the movement-expression generation unit 51, the voice synthesized by the voice synthesis unit 55, and the words output by the text output control unit 54, and in addition, simultaneously with the words being read aloud by the voice, they are displayed in a conversation balloon, and the display ends simultaneously with the completion of the reading of the words aloud.

Next, an explanation will be given of the case wherein the state of the dialogue flow is confirmation, and the dialogue flow does not switch, but the flow fails.

In this case, the movement-expression generation unit 51 calls the data corresponding to a failure movement from the movement data memory unit 52, generates the movement of the human image expressing sadness, and the user is informed that the dialogue has failed (step 316). Next, the movement-expression generation unit 51 analyzes the spoken text sent from the dialogue flow analysis unit 4, uses the keyword movement pattern conversation table stored in the text-movement association memory unit 53 to associate keywords of the spoken text and movement patterns, determines the movement pattern from the spoken text, calls the corresponding movement pattern data from the movement data memory unit 52, and generates the movement (step 317). In addition, when the dialogue flow is confirmation, the text output control unit 54 carries out control so that words are output to a conversation balloon (step 318). The voice synthesis unit 55 accepts the spoken text sent from the dialogue flow analysis unit 4 as input, and carries out voice synthesis of the words (step 324). For the spoken text whose key words are extracted, the synchronization unit 56 synchronizes the display of the commencement of motion generated by the movement-expression generation unit 51, the voice synthesized by the voice synthesizer 55, and the words output by the text output control unit 54, and in addition, displays the conversation balloon simultaneously with the voice reading aloud the words.

Next, the operation when the state of the dialogue flow, which is confirmation without switching or failure of the dialogue flow, is repeated will be explained.

In this case, the movement-expression generation unit 51 analyzes the spoken text first sent from the dialogue flow analysis unit 4, uses the text movement association table to associate keywords of the spoken text and movement patterns, determines the movement pattern from the spoken text, and calls the corresponding movement action from the movement data memory unit 52 (step 319). Next, the movement pattern data is modified according to the number of repetitions of the dialogue flow and the movement generated (step 320). For example, the movement-expression generation unit 51 extracts the keywords "please enter" for the spoken text "please enter the items on the left" in the dialogue flow, uses the text movement association table stored in the text-movement association memory unit 53, determines the movement pattern to be "pointing to the right", and next, when the dialogue flow is repeated two times, a modified movement is generated in which the pointing motion is exaggerated. The exaggerated pointing motion can have a "nodding" for emphasis, or the hand shaking within a specified range. In addition, since the dialogue flow is confirmation, the text output control unit 54 carries out control so that the words are output to a conversation balloon (step 321). The voice synthesis unit 55 accepts the spoken text sent from the dialogue flow analysis unit 4 as input, and carries out voice synthesis (step 324). For the spoken text whose keywords have been extracted, the synchronization unit 56 synchronizes display of the commencement of the movements generated by the movement-expression generation unit 51, the voice synthesized by the voice synthesis unit 55, and the words output by the text output control unit 54, and in addition, simultaneously with the words being read aloud, they are displayed on a conversation balloon.

Next, the operation when the state of the dialogue flow, which is confirmation but without switching, failure, or repetition of the dialogue flow, will be explained.

In this case the movement-expression generation unit 51 analyzes the spoken text sent from the dialogue flow analysis unit 4, uses the text-movement association chart stored in the text-movement association memory unit 53 that associates the keywords of a spoken text and a movement pattern, determines the movement pattern from the spoken text, calls the corresponding movement pattern data from the movement data memory unit 52, and generates the motion (step 322). Since the dialogue flow is confirmation, the text output control unit 54 carries out control so that the words are output to a conversation balloon (step 323). The voice synthesis unit 55 accepts the spoken text sent from the dialogue flow analysis unit 4 as input, and carries out voice syntheses of the words (step 324). For the spoken text whose keywords have been extracted, the synchronization unit 56 synchronizes the display of the commencement of the movements generated by the movement-expression generation unit 51, the voice synthesized by the voice synthesis unit 55, and the words output by the text output control unit 54, and in addition, simultaneously with the reading of the words aloud, they are displayed in a conversation balloon.

EXAMPLE OF A SPECIFIC OPERATION

Using as an example the dialogue flow of the airline ticket reservation service shown in FIG. 2, the situation of the interaction between the user and system is concretely explained by associating it with each of the component parts in FIG. 1.

When the user starts the airline ticket reservation service, the dialogue control unit 2 refers to the dialogue flow stored in the dialogue flow memory unit 3, first outputs to the user the words "Do you have an ABC card?", and then carries out confirmation of the answer (step 210). The words and the dialogue flow in step 201 are sent to the dialogue flow analysis unit 4, and based on the flow chart shown in FIG. 3, the dialogue flow analysis unit 4 determines whether or not the state of the dialogue flow in step 201 is confirmation or guidance (step 301); next, whether or not the state of the dialogue flow is switch or not (step 302); next, whether or not the state of the dialogue flow is a failure step 303); and finally, whether or not the state of the dialogue flow is a repetition (step 304).

In this example, since the state of the dialogue flow in step 201 is a confirmation without switching, failure, or repetition, the spoken text "Do you have an ABC card?" is sent to the movement-expression generation unit 51, the text output control unit 54, and the voice synthesis unit 55.

The movement-expression generation unit 51 analyzes the text of "Do you have an ABC card?", extracts the keyword "Do you?", uses the text-movement association chart stored in the text-movement association memory unit 53 shown in FIG. 5, determines that the movement pattern corresponding to "Do you" is "confirmation", and generates the movement data stored in the movement data memory unit 52, for example, of tilting the head, for "confirmation" (step 322).

The text output control unit 54 outputs the words "Do you have an ABC card?" to the conversation balloon (step 323), and the voice synthesis unit 55 carries out the voice syntheses of the words "Do you have an ABC card?" (step 324).

The synchronization unit 56 synchronizes the movement-expression generation unit 51, the text output control unit 54, and the voice synthesis unit 55. Until the text "Do you have an ABC card?" is analyzed and the keywords "Do you" are extracted, the movement-expression generation unit 51 does not generate motion of the human image. The text output control unit 54 outputs the characters "Do you have an ABC card?" to the conversation balloon, and simultaneously, the voice synthesis unit 55 carries out the voice synthesis of the characters "Do you have an ABC card". Simultaneously with the commencement of the keywords "Do you", the movement-expression generation unit 51 generates the motion of tilting the head, the text output control unit 54 outputs characters the conversation balloon, and the voice synthesis unit 55 carries out voice synthesis.

The dialogue control unit 2 advances the dialogue flow, and determines whether the answer of the user to "Do you have an ABC card?" is "yes" or "no" (step 202). If the answer is "yes", the confirmation "Please enter the items to the left" is sent to the user (step 204). If the answer is "no", the confirmation "Please enter your name and telephone number" (step 203) is sent to the user. These dialogue flows moves to the dialogue flow analysis unit 4.

In the dialogue flow analysis unit 4, because the state of the dialogue flow corresponding to "Please enter the items on the left" and "please enter your name and telephone number" are both confirmations without switching of the flow, failure, or repetition, these spoken texts are sent to the movement-expression generation unit 51, the text output control unit 54, and the voice synthesis unit 55 in the same manner as the above example "Do you have an ABC card?"

The movement-expression generation unit 51 analyzes these spoken texts, extracts the key words "please enter" as a result, uses the text-movement association chart stored in the text-movement association memory unit 53, determines that the movement pattern corresponding to "please enter" is "pointing to the right", and using the movement data stored in the movement data memory unit 52, generates the motion of the index finger being extended and pointing to the right. The text output control unit 54 outputs the words to the conversation balloon, and the voice synthesis unit 55 carries out the voice syntheses. The synchronization unit 56 synchronizes the movement-expression generation unit 51, the text output control unit 54, and the voice synthesis unit 55.

Here, FIG. 7 shows an example of the screen that the service application 8 and the human image generation unit 5 display on the display 6 when the dialogue is in the state of step 204.

The dialogue control unit 2 sends the results of the user's input for the input items such as the point of departure, destination, the departure date, the return date, etc., to the service application 8, and the service application 8 searches for airline tickets satisfying the entered items, and returns the results to the dialogue control unit 2.

Next, the dialogue control unit 2 determines whether there are one or more results or no results (step 205), and if there are one or more results, in order to carry out confirmation by the user for "Please enter the desired item" (step 207), the data flow moves to the dialogue flow analysis unit 4. In the dialogue flow analysis unit 4, as in the above example, the spoken text is output to the movement-expression generation unit 51, the text output control unit 54, and the voice synthesis unit 55, the movement pattern "pointing to the right" corresponding to the key words "please enter" is generated by the movement-expression generation unit 51, and the text output control unit 54, the voice synthesis unit 55, and the synchronization unit 56 output the words to the conversation balloon, and voice synthesis is carried out.

Next, the dialogue control unit 2 determines whether or not the entered arrival time is at 21:30 or latter (step 208). If the arrival time is after 21:30, the dialogue control unit 2 proceeds to step 209. The dialogue flow at step 209 outputs "If you arrive at 21:30 or latter, you can use a discount tickets" as guidance that outputs only a message not accompanying the input of the user, separately from the confirmation brought about by the users input. Because the state of the dialogue flow at step 209 is guidance, the dialogue flow analysis unit 4 informs the text output control unit 54 that the dialogue flow is guidance, and sends to spoken text to the text output control unit 54 and the voice synthesis unit 55.

When the movement-expression generation unit 51 inputs the message from the dialogue flow analysis unit 4 that the state of the dialogue is guidance, it reads from the movement data memory unit 52 the movement pattern corresponding to this guidance, and generates the movement of the human image according to the contents of the movement associated with this movement pattern. In the case of this example, the movement pattern associated with guidance is "pointing downward", so (step 311) the contents of the movement of the movement pattern associated with "pointing downward" is read from the movement data memory unit 52, and the motion of the human image to be displayed in the display unit 6 is generated.

In addition, as shown in FIG. 6, the text output control unit 54 outputs to the message board "If you arrive at 21:30 or letter, you can use a discount tickets" (step 312), and this display continues even after the human image has finished speaking so the user can thoroughly read the message. The voice synthesis unit 55 carries out voice syntheses of the words (step 324).

In the dialogue control unit 2, if the number of results at step 205 is determined to be 0, the dialogue control unit 2 advances to step 206, and in order to send the confirmation to the user that "There is no relevant data", sends the dialogue flow to the dialogue flow analysis unit 4.

In the dialogue flow analysis unit 4, since the dialogue flow is confirmation without switching the flow, failure, or repetition, the spoken text is output to the movement-expression generation unit 51, the text output control unit 54, and the voice synthesis unit 55.

The movement-expression generation unit 51 analyzes the spoken text, extracts the key words "there is no", uses the text-movement association chart stored in the text-movement movement association memory unit 53, determines that the movement pattern corresponding to "there is no" is "refusal", and generates movement using the movement data for shaking the head stored in the movement data memory unit 52. In the text output control unit 54, the words are output to the conversation balloon, in the voice synthesis unit 55, voice synthesis of the words is carried out, and the output is synchronized by the synchronization unit 56.

Next, the dialogue flow at step 204 is repeated. Since the dialogue flow is confirmation and the flow is repeating, the movement-expression generation unit 51 first analyzes the spoken text "please enter the items to the left", extracts the key words "please enter", uses the text movement association table stored in the text-movement association memory unit 53, and determines the corresponding movement pattern for "point to the right". Since the dialogue flow is repeated two times, a modified movement is generated in which the pointing motion is exaggerated. For emphasis, the exaggeration modification can include, for example, nodding the head and shaking the hand within a specified range. The text output control unit 54 outputs the words to the conversation balloon, the voice synthesis unit 55 carries out voice synthesis of the words, and the output is synchronized by the synchronization unit 56.

When step 209 has finished, the dialogue flow moves to step 210 by the dialogue control unit 2. In addition, at step 208, when it is determined that the arrival time is not at 21:30 or latter, the processing moves to step 210, and this dialogue flow moves to the dialogue flow analysis unit 4.

Since the dialogue flow at 210 is confirmation without flow switching, failure, or repetition, the dialogue flow analysis unit 4 sends the spoken text of the dialogue flow to the movement-expression generation unit 51, the text output control unit 54, and the voice synthesis unit 55.

The movement-expression generation unit 51 analyzes the text of "Thank you for using this system", extracts the key words "thank you", uses the text movement association stored in the text-movement association memory unit 53, determines that the movement pattern corresponding to "thank you" is a "polite greeting", and generates the movement data for the "polite greeting", for example, bowing politely arranging both hands in front of the body, stored in the movement data memory unit 52.

The text output control unit 54 outputs to the conversation balloon the words "Thank you for using this system", the voice synthesis unit 55 carries out the voice synthesis for "Thank you for using this system", and the synchronization unit 56 synchronizes the output.

Above, an explanation was made for an embodiment and an example of the present invention, and it is possible to realize the present invention using a computer. In this case, the effect of the invention is not lost when provided by a representative recording medium each as a CD-ROM or floppy disc recording the programs that generate on a computer the dialogue control unit 2, the dialogue flow memory unit 3, the dialogue flow analysis unit 4, and the human image generation unit 5 explained above.

In addition, in the embodiment of the present invention, because the expressions and movements of the human image are generated automatically simply by just inputting the dialogue flow and words of the system response, the system can be constructed without a great expenditure of labor. In addition, because the movement and expressions are associated with the state of the dialogue during the dialogue flow and the spoken text, different gestures appear depending on the state of the dialogue, such as repetition and failure, even when the spoken text is the same, and the user is given a natural feeling that is close to a dialogue between human beings.

The first effect of the present invention is that in a dialogue system using a human image as a user interface for the expressions and motions of the movements of the human image, it is possible to construct the system without a great expenditure of labor. The reason is that the expressions and movements of the human image are generated automatically from the dialogue flow and words of the system response.

The second effect of the present invention is that appropriate movements and expressions of the human image are generated according to the state of the dialogue, and the user is given a natural feeling that is close to a dialogue between human beings. The reason is that because the movements and expressions are determined associated with the state of the dialogue during are determined with the state of the dialogue and the spoken text, suitable expression is attained by different gesture appearing, depending on the state of the dialogue even when the spoken text is the same.

What is claimed is:

1. A human image dialogue device that is a system that carries out a dialogue with a user by producing a human image on a computer and generating this human image, characterized in providing:

a dialogue flow memory unit that stores a dialogue flow describing in a flow format the spoken text for the responses of said system and the state of the dialogue during this response;

a dialogue control unit that advances the responses of the user and the system by referring to the dialogue flow stored in said dialogue flow memory unit;

a dialogue flow analysis unit that carries out analysis of said dialogue flow to which said dialogue control unit refers; and a human image generation unit that accepts the results of the analysis of said dialogue flow from said dialogue analysis unit, and generates the movements of said human image from said spoken text in said dialogue flow and the state of said dialogue.

2. A human image dialogue device according to claim 1, wherein said human image generation unit characterized in providing for generating the movements of said human image, at least:

a text movement association memory unit that stores the correspondences between the key words that may be contained in said dialogue text and the movement patterns;

a movement data memory unit that stores the movement data corresponding to said movement pattern; and a movement-expression generation unit that generates movements of said human image from said spoken text in said dialogue flow and the state of said dialogue by referring to said text movement association memory unit and said movement data memory unit.

3. A human image dialogue device according to claim 2 characterized in further providing a text output control unit that carries out control in order that said human image generation unit represents said spoken text disclosed in said dialogue flow.

4. A human image dialogue device according to claim 3 characterized in that said text output control unit switches the display format of said dialogue text depending on the state of the dialogue disclosed in said dialogue flow.

5. A human image dialogue device according to claim 3 characterized in further providing a voice synthesis unit wherein said human image generation unit carries out and outputs the voice synthesis of said dialogue text disclosed in said dialogue flow.

6. A human image dialogue device according to claim 5 characterized in providing a synchronization unit that synchronizes the movements of the human image generated in said movement expression generation unit, the spoken text displayed by said text output control unit, and the voice synthesis output by said voice synthesis unit, and wherein the timing of the commencement of the movements of said human image, the spoken text, and the voice output are synchronized.

7. A human image dialogue device according to claim 4 characterized in further providing a voice synthesis unit wherein said human image generation unit carries out and outputs the voice synthesis of said dialogue text disclosed in said dialogue flow.

8. A recording medium that records a human image dialogue program that makes possible the generation of the human image by a computer in a system that carries out a dialogue with a user by providing a human image on the computer, and this computer making possible the generation of:

a dialogue flow memory function that stores a dialogue flow describing in a flow format the spoken text for the response of said system and the state of the dialogue at the time of the response;

a dialogue control function that advances the responses of the user and the system by referring to the dialogue flow stored by said dialogue flow memory function;

a dialogue flow analysis function that carries out analysis of said dialogue flow to which said dialogue control function refers; and a human image generation function that receives the results of the analysis of said dialogue flow from said dialogue flow analysis function and generates the movements of said human image from said spoken text in said dialogue flow and the state of said dialogue.

9. A recording medium according to claim 8 that records a human image dialogue program wherein said human image generation function characterized in providing for generating the movements of said human image, at least:

a text movement association function unit that stores the correspondences between the key words that may be contained in said dialogue text and the movement patterns;

a movement data memory function that stores the movement data corresponding to said movement pattern; and a movement-expression generation function that generates movements of said human image from said spoken text in said dialogue flow and the state of said dialogue by referring to said text movement association memory unit and said movement data memory unit.

10. A recording medium according to claim 9 that records a human image dialogue program characterized in further providing a text output control function that carries out control in order that said human image generation unit represents said spoken text disclosed in said dialogue flow.

11. A recording medium according to claim 10 that records a human image dialogue program characterized in that said text output control function switches the display format of said dialogue text depending on the state of the dialogue disclosed in said dialogue flow.

12. A recording medium according to claim 11 characterized in further providing a voice synthesis function wherein said human image generation function carries out and outputs the voice synthesis of said dialogue text disclosed in said dialogue flow.

13. A recording medium according to claim 10 characterized in further providing a voice synthesis function wherein said human image generation function carries out and outputs the voice synthesis of said dialogue text disclosed in said dialogue flow.

14. A recording medium according to claim 13 that records a human image dialogue program characterized in providing a synchronization function that synchronizes the movements of the human image generated in said movement expression generation function, the spoken text displayed by said text output control function, and the voice synthesis output by said voice synthesis function, and wherein the timing of the commencement of the movements of said human image, the spoken text, and the voice output are synchronized.

* * * * *